US005916373A

United States Patent [19]

Schneider

[11] Patent Number: 5,916,373

[45] Date of Patent: Jun. 29, 1999

[54] REMOVING OF DUST PARTICLES FROM A RELATIVELY MOVING MATERIAL WEB

[75] Inventor: Robert Nicolas Schneider, Basel, Switzerland

[73] Assignee: Patent Consulting & Development GmbH, Reinach, Switzerland

[21] Appl. No.: 08/793,973

[22] PCT Filed: Sep. 6, 1995

[86] PCT No.: PCT/CH95/00196

§ 371 Date: Mar. 6, 1997

§ 102(e) Date: Mar. 6, 1997

[87] PCT Pub. No.: WO96/07460

PCT Pub. Date: Mar. 14, 1996

[30] Foreign Application Priority Data

Sep. 6, 1994 [CH] Switzerland ..... 2719/94
May 5, 1995 [CH] Switzerland ..... 1302/95

[51] Int. Cl.[6] ..... B08B 1/02

[52] U.S. Cl. ..... 134/15; 134/21; 134/37

[58] Field of Search ..... 134/15, 21, 37

[56] References Cited

U.S. PATENT DOCUMENTS 4,486,238 12/1984 Bando ..... 134/37
5,304,254 4/1994 Chino et al. ..... 134/37
5,421,901 6/1995 Whitney et al. ..... 134/15

*Primary Examiner*—Lyle A. Alexander

[57] ABSTRACT

According to a method to remove dust particles from a stable material web which moves relative to a contact-free operating de-dusting device, a blower unit of the de-dusting device is provided at a specified first distance (d) and a grounded potential surface at a second distance (d) from the surface of the material web. The velocity and the pressure between the surface of the material and the potential surface of the ultrasonic gas flow existing from the blower unit is adjusted so that the product of the pressure and of the second distance (d) according to Paschen's law makes a discharge of the dust particles on the surface of the material feasible relative to the grounded potential surface. Furthermore, the adhesive forces (van der Waals forces) are overcome by the ultrasonic gas flow. Thus, these dust particles attached to the surface of the material are picked up by the ultrasonic gas flow without using electrically biased discharge electrodes, requiring electrical energy, and are removed by suction by at least one suction unit. The high operating expenses, required for equipment with electrically biased discharge electrodes, become superfluous with the described method.

13 Claims, 5 Drawing Sheets

REMOVING OF DUST PARTICLES FROM A RELATIVELY MOVING MATERIAL WEB

BACKGROUND OF THE INVENTION

1. Field of the Invention

The invention relates to a process for removing dust particles from a web surface without contact, as well as a dedusting device for accomplishing the process.

2. Related Art

The designs of dedusting systems for moving material webs, also referred to as web-cleaning systems, can be roughly divided into those that operate without contact and those that operate with brush support. In the latter dedusting systems, the dust particles were mechanically removed from the material web with rotating brushing rollers or rows of stationary brushes and then suctioned off. The composition of the brushes, as well as their strength, material, and bristle design were matched in this case to the properties of the material surface that was to be cleaned. Such non-generic dedusting systems are described in Bundesverband Druck e.V. [Federal Registered Association of Pressure], P.O. Box 1869, Biebricher Allee 79, D - 6200 Wiesbaden 1, "Technischer Informationsdienst [Technical Information Services]," II/1985, pp. 1 to 20, as well as in WO87/06527.

Dedusting systems that operated without contact had an injection unit, which directed a gas jet onto the web to be cleaned, as well as a suctioning unit, with which the gas that picked up the dust particles was suctioned off in turn. To discharge the dust particles that were found on the material web, discharge electrodes were arranged together with the injection unit or near it. Such dedusting systems are known from EP-A 0 245 526, EP-A 0 520 145, EP-A 0 524 415, EP-A 0 395 864 and CH-A 649 725.

Another approach was used in EP-A 0 084 633. Here, a turbulent flow of gas was directed toward a fabric web that was to be dedusted, and the latter was made to vibrate by the turbulent flow, causing the dust particles to be removed from the surface of the fabric. It was possible to use this type of dedusting only in the case of thin material webs, however, that could be made to vibrate by the gas jet.

A non-generic cleaning system for removing a liquid adhering to a moving belt, especially a rolling belt, is described in DE-A 4 215 602. The problems that arise in the case of a dedusting system with particles that adhere to the surface owing to electrostatic forces did not occur here.

To the extent that a fluidic configuration of the nozzle outlets of the injection units was implemented in the above-indicated dedusting systems, they were designed as channels that were inclined toward the material web with a constant channel cross-section in the area of the nozzle opening, as depicted in, e.g., EP-A 0 245 526, EP-A 0 520 145 and DE-A 4 214 602. Only in EP-A 0 084 633 and in an embodiment variant of DE-A 4 215 602 was an exhaust port cross-section of the nozzle with a variable cross-section described. In EP-A 0 084 633, the flow of gas was directed perpendicularly to the fabric web. In DE-A 4 215 602, a nozzle that was inaccurately referred to as a Laval nozzle was used with a cross-section which, after a narrowing, widens in a pear shape and then narrows again.

The invention achieves the object of ensuring the dedusting of a moving, stable material web that is not to be made to vibrate for dedusting, in which discharge electrodes are unnecessary.

BRIEF SUMMARY OF THE INVENTION

The invention is based on the first surprising finding that efficient dedusting is possible only through the selection of a gas jet, especially its pressure, on an area of a material web surface that is to be dedusted as well as through the selection of the spacing of this area from a grounded surface. It is now assumed that efficient dedusting is possible only if the gas pressure of the flow of gas that is produced in the area to be dedusted is so large that the critical voltage that corresponds to the product of the gas pressure and the above distance according to Paschen's Law is smaller than the electrostatic voltage (charge) of the dust particle, which mainly causes the latter to adhere to the material web surface. Thus, under these conditions, self-discharging of the dust particles is carried out. They are neutralized. They now adhere owing only to the considerably weaker van der Waals forces and other non-electrostatic forces. The gas speed of the flow of gas that produces the conditions of Paschen's Law is now high enough to remove also the dust particles that adhere only weakly.

The discharge effect (Paschen's Law) is supported by the effect of ballo-electricity (Lenard effect), as is produced by the narrowing nozzle cross-section. For this purpose, at least partial ionization of the flushing gases, here air, is carried out without using any ionization unit that requires electrical energy.

The second surprising finding is based on the fact that owing to the special configuration of the suctioning unit, the flow of gas is deflected at a deviation angle and thus promotes the necessary suctioning effect of the dust particles into the suctioning unit.

Starting from these findings, there are for one skilled in the art a considerable number of possible configurations, whereby here only a few of them can be described.

The almost daily tear-down process for cleaning high-voltage electrodes and their subsequent exact adjustment during reinstallation thus are avoided in devices that are designed according to the invention.

The required flow of gas can be achieved preferably by the configuration of the injection unit and/or the suctioning unit, as it is or they are described in the dependent claims.

Below, examples of the process according to the invention as well as the devices that can be used to implement the process in a preferred way are described in more detail based on the drawings. In addition to the nozzle outlets and designs that are described here, of course, other embodiments can also be used if the conditions for discharge of the dust particles as well as overcoming their holding forces on the material web that are described below are achieved without using high-voltage electrodes that require electrical energy. Other advantages of the invention follow from the text of the description below.

DETAILED DESCRIPTION OF THE DRAWINGS

Figure 1:
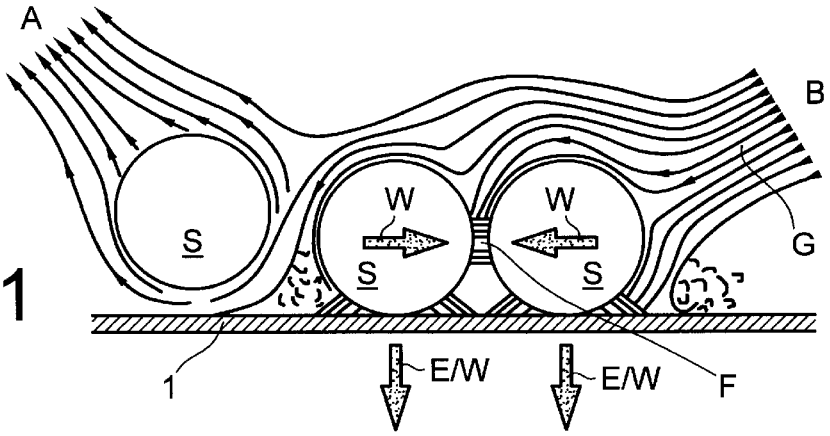
FIG. 1 shows a diagrammatic representation of the forces that hold dust particles on a material web.

In FIG. 1, the electrostatic and van der Waals forces E and W that act on dust particles S are depicted diagrammatically. Dust particles S are also often held by liquid bridges F. Flow of gas G that acts on dust particles S enters right side B of FIG. 1. Flow of gas G is suctioned off on left side A.

Figure 2:
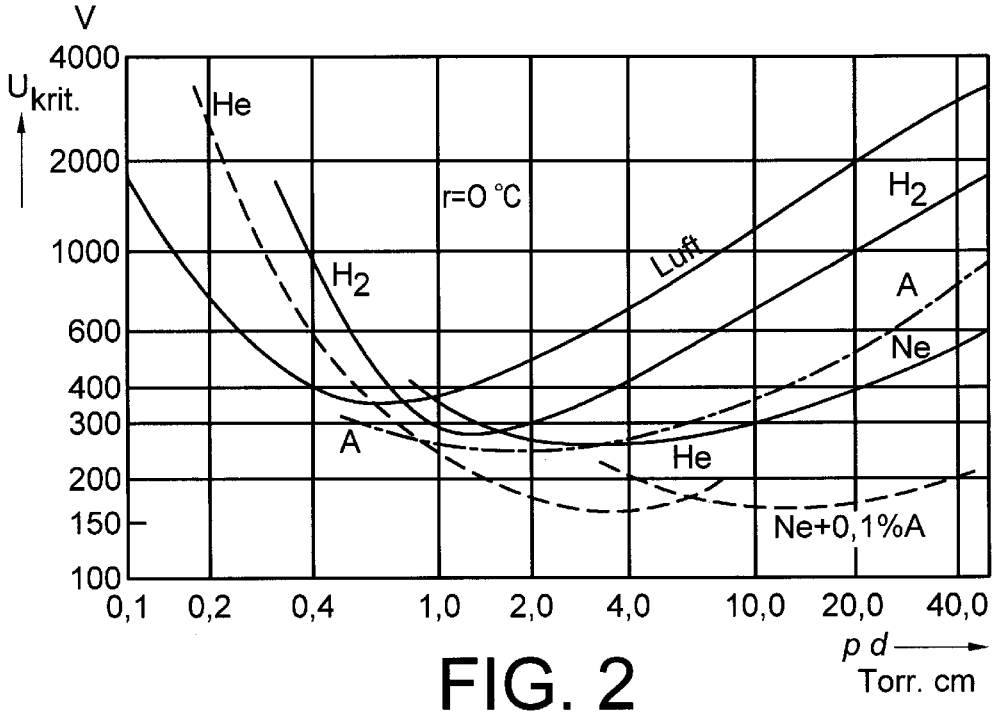
FIG. 2 shows Paschen's Law.

In FIG. 2, Paschen's Law—the dependence of critical voltage U/crit on the product of pressure p and distance d for various gases—is applied. FIG. 2 is a copy of image 6.20 from K. Simonyi, "Physikalische Elektronik [Physical Electronics]," Verlag B. G. Teubner Stuttgart, 1972, page 526. Paschen's Law is described, i.a., in the book just cited here on pages 524 to 526, as well as in Ch. Gertsen, "Physik [Physics]," Springer-Verlag 1960, p. 303. By this law, the critical electrical voltage U/crit is indicated at which a discharge between two flat electrodes "lignites," whereby p is the pressure in the flow of gas between the electrodes. The pressure-distance product p.d is indicated on the abscissa of FIG. 2 in Torr.cm, whereby 1 torr is 133 Pa at 0° C.

According to the invention, Paschen's Law is now used when a material web 1 is dedusted. Dust particles S adhere to the latter because of their electric charge. According to the invention, an injection unit 3*a*/*b* of the dedusting device with a grounded potential surface is now arranged at a distance d from the material web surface, and the speed and the pressure between the material surface and the potential surface of ultrasonic flow of gas G that exits from injection unit 3 are adjusted in such a way that the voltage that is caused by charged dust particles S is equal to the critical voltage U/crit in Paschen's Law. The product p.d that is required for critical voltage U/crit can now be found from FIG. 2. The gas pressure between the material surface that carries dust particles S and the grounded potential surface is now adjusted in such a way that the value of product p.d that is found above is approximated at specified design distance d between the material surface and the grounded potential surface. With the aid of an electronic field meter, it can be determined how high the electric charge is. This makes it possible to optimize the product p.d during the installation and adjustment of the dedusting device. The required conditions can be achieved with ultrasonic flow of gas G. Discharged dust particles S are now picked up by ultrasonic flow of gas G without using electrically biased discharge electrodes and are suctioned off by a suction unit 7. The high maintenance costs that are required for systems with electrically biased discharge electrodes are thus avoided here.

Injection unit and suctioning unit 3*a*/*b* or 7*a*/*b* are made from metal and grounded. The distance between injection unit 3*a*/*b* and the surface of material web 1 is therefore equal to distance d between the grounded potential surface and the latter. To obtain good electrical conductivity, the surfaces of injection unit and suction unit 3*a*/*b*, or 7*a*/*b*, facing material web 1, can be coated with an electrically conductive layer. In the case of aluminum, e.g., an anodizing process would be used to obtain good electrical conductivity.

Figure 3:
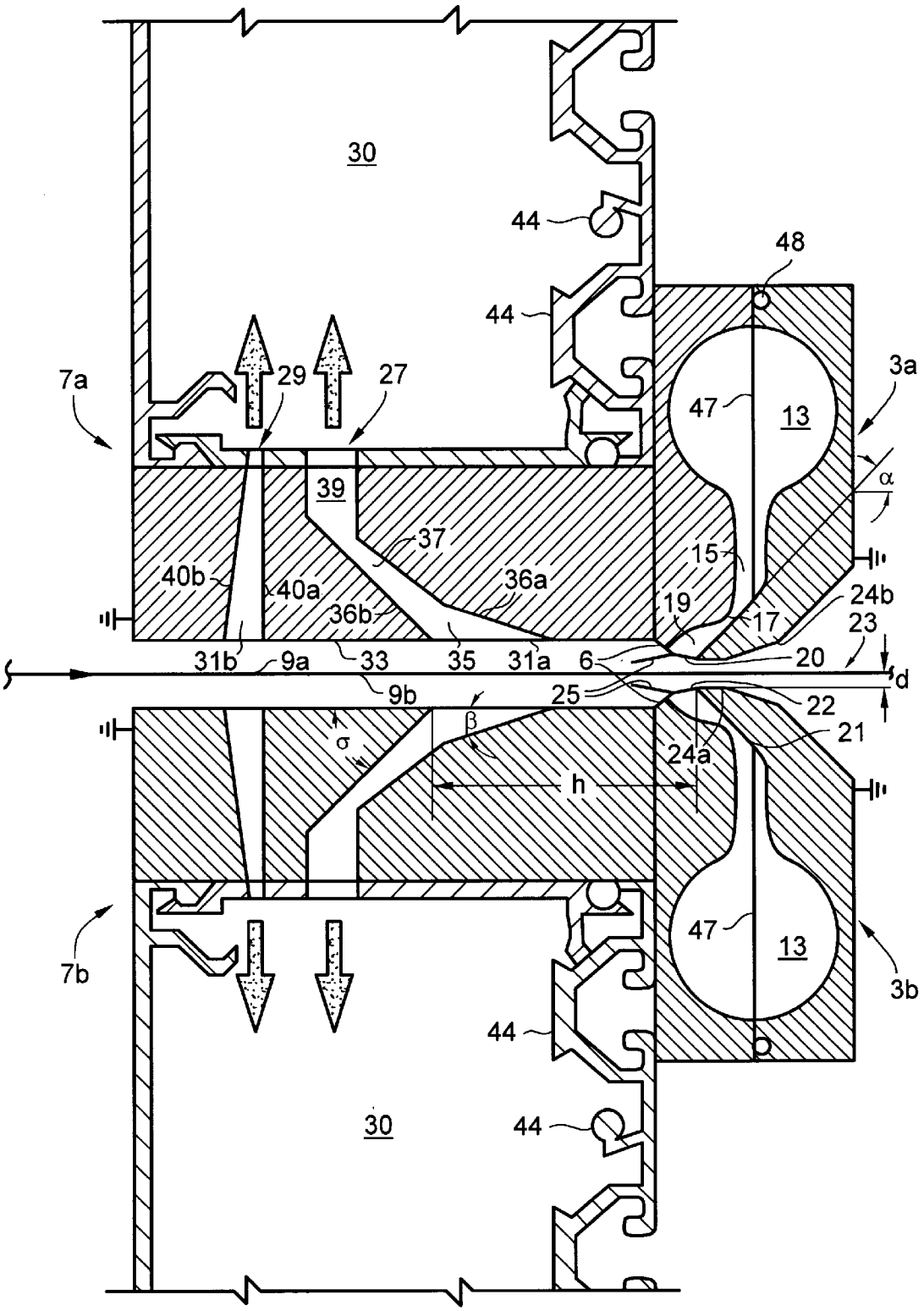
FIG. 3 shows a cross-section through the dedusting device.

In the dedusting device that is depicted in cross-section in FIG. 3, dedusting of both upper side 9*a* and of lower side 9*b* of material web 1 is possible. For this purpose, one injection unit 3*a* and 3*b* each and one suction unit 7*a* and 7*b* each are arranged on upper side 9*a* and on lower side 9*b*. The movement of material web 1 is accomplished in the direction of arrow 11. The conveying speed of material web 1 is about 4.75 to 15 m/s in the embodiment that is described here. The conveying speed has no effect on the efficiency of the dedusting device.

Injection device 3*a*, or 3*b*, that is described below is designed in such a way that an ultrasonic flow of gas, here ultrasonic flow of air G, exits from it. Flow of gas G that exits from injection device 3*a*/*b* reaches the surface of material web 1 at an angle $\alpha$ of between 20° and 100°, preferably between 30° and 55° in relation to its direction of movement 11. Suctioning off of dust particles S that are lifted from the material surface is done in direction of flow 25 of discharging gas G, downstream at a first angle a of between 20° and 70°, preferably at about 45° and again downstream at a second point that is approximately perpendicular to the material surface. This second suctioning acts in particular on dust particles S that lie in indentations and holes.

Injection unit 3*a*/*b* has a two-part nozzle design that is described below. Starting from a pressure channel 13 as a gas supply unit, a continuously tapering nozzle cross-section 15 is present, which after a narrowing 17 turns into a continuously widening nozzle cross-section 19 until it reaches a nozzle outlet 20. The width of narrowing 17 lies between 0.02 mm and 0.08 mm, preferably less than about 0.04 mm. The opening angle at nozzle outlet 20 lies between 3° and 15°, but preferably between 5° and 10°. The surface line that lies to the left in the cross-section of FIG. 3 in widening nozzle cross-section 19 is designed in a curved manner, while the opposite surface line is a straight line 21. This straight line 21 runs at angle a to the plane of material web 1. Angle a lies between 20° and 100°, preferably between 30° and 55°. Edge point 22 of this straight line 21 at nozzle outlet 20 has smallest distance d to material web 1, which lies between 0.5 and 2 mm depending on the material to be dedusted. This distance d corresponds to distance d of Paschen's Law. Opening 23 between two injection units 3*a* and 3*b* is designed in the shape of a "V" that widens by a factor of three in direction of movement 11, whose leg angle increases at each transition stage 24*a* and 24*b*.

The discharge of gas from nozzle opening 20 takes place, as indicated in FIG. 3 by an arrow 25, obliquely to material web 1 in relation to its direction of movement 11 toward suction unit 7*a* or 7*b* in question.

Edge point 22 is designed as a sharp edge. Because of this sharp edge 22, when ultrasonic flow G exits from nozzle outlet 20, an area of flow turbulence develops whose turbulences promote the lifting of dust particles S that are discharged according to Paschen's Law from surface 9*a*, or 9*b* of material web 1 in opposition to van der Waals forces W. Injection units 3*a* and 3*b* are made of metal and are grounded by a diagrammatically represented electrical ground analogously to suction unit 7*a* and 7*b*. Nozzle outlet 20 lies in a plane 6, which cuts material web 1 at an angle of between 25° and 65°, preferably at 45°.

Analogously to two injection units 3*a* and 3*b*, two suction units 7*a* and 7*b* are also present. Two suction units 7*a* and 7*b* are arranged and designed symmetrically to one another. Each of two suction units 7*a* and 7*b* has two suction channels 27 and 29, which end in a suction chamber 30. The intakes of suction channels 31*a* and 31*b* are arranged in a plane 33, which has a constant distance from upper side 9*a* or lower side 9*b* of material web 1. Plane 33 is simultaneously the upper side of suction unit 7*a* or 7*b* that is opposite the material upper side or lower side. Suction units 7*a* and 7*b* are preferably made of electrically conductive material (metal). If other material should be used, however, or if over time the metal can be coated with a non-conductive corrosion covering, this surface, as also that of injection units 3*a* and 3*b*, as already explained above, is to be provided with an electrically conductive layer. Plane 33 is, as depicted in FIG. 3, shifted to the rear relative to nozzle outlet 20. This rearward shift may also be smaller. Plane 33 could also be arranged right at nozzle outlet 20.

Suction channel 27 has a suction opening 35 that is tapered like a funnel and is inclined against the surface of material web 1. The inclination of suction opening 35 is directed toward nozzle outlet 20. Surface line 36*a* of funnel-shaped suction opening 35 that faces nozzle outlet 20 has an angle β that is as flat as possible to the surface of material web 1. Angle β lies between 15° and 30°. Other surface line 36*b* of suction opening 35 that is opposite to surface line 36*a* is steeper and on the surface of material web 1 has an angle σ of between 20° and 70°. Since in any case suction opening 35 is to be designed funnel-shaped, it is impossible that the two extreme angle values of 30° can be used together at angles β and σ.

Suction opening 35 then turns into a narrowed channel piece 37, one surface line of which is the extension of surface line 36*b*. This channel piece 37 widens into another channel piece 39, which then leads into suction chamber 30.

Distance h of the point of intersection of surface line 36*b* with plane 33 from edge 22 (=one lower end of straight lines 21) is 10 to 25 times distance d. Suction channel 27 of optionally adhering dust particles S is flushed clear by the arrangement of injection unit 3*a* or 3*b*.

Suction channel 29 is also designed in the shape of a funnel, whereby, however, its surface line 40*a* that faces nozzle outlet 20 runs perpendicular to the surface of material web 1, while surface line 40*b* that is opposite to the above runs slightly inclined toward the surface of material web 1.

Suction chamber 30 has at least one shaped piece 44 in each case at one of its opposite walls. This shaped piece 44 is used to hang flow baffles, not shown. The flow baffles are necessary to ensure that approximately identical pressure conditions prevail in suction chamber 30 as much as possible over all junctions of channels 27 and 29.

To dedust material web 1, which moves at a speed of up to 30 m/s, air G is blown by injection unit 3*a* and 3*b* at an air speed of up to a maximum of 550 m/s. To achieve this discharge speed, a pressure of about 2 bar prevails in pressure channel 13. On the surface of material web 1, there is then a pressure, depending on the selected ultrasonic-gas speed, of 50 to 100 mbar. Dust particles 5 that are located on the surface of material web 1 are now neutralized because of the above-described regularities of Paschen's Law in a dark discharge, which in principle is a glow discharge at very low current intensities. Simultaneously, the lifting of dust particles S is carried out by ultrasonic flow of air G, supported by swirling, caused by edge 22 against the van der Waals forces that act on them. Dust particles S are suctioned off by suction channels 27 and 29, whereby channel 29 that runs almost perpendicular to the surface of material web 1 is used mainly to pick up dust particles S from indentations and holes.

The air that is injected through the injection unit or units 3*a* and 3*b*, as well as the suctioning capacity of suction unit or units 7*a* and 7*b* lies in the temperature range of 18° C. to 23° C. In the space in which the dedusting device stands, overpressure prevails.

Figure 4A:
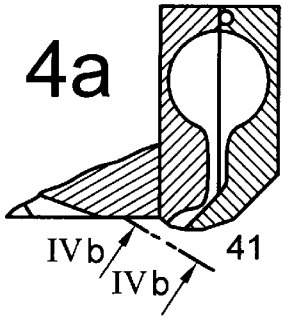
FIGS. 4*a* and 4*b* show a partial cross-section and a top view in direction IVb of an injection unit of the dedusting device with a slot-shaped gas outlet.
Figure 5A:
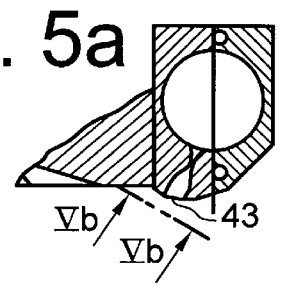
FIGS. 5*a* and 5*b* show a representation, analogous to FIGS. 4*a* and 4*b*, of a gas outlet that is arranged in a row of nozzles.
Figure 4B:
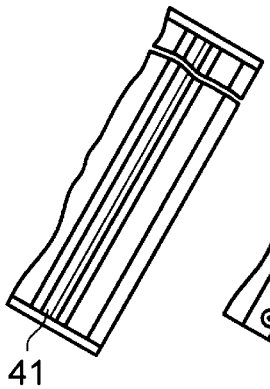
Figure 5B:
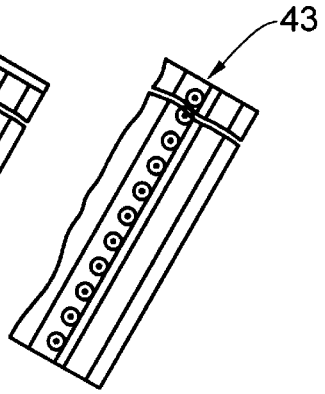

Nozzle outlet 20, as well as the intakes to channels 27 and 29, can now, as depicted on an enlarged scale once in cross-section in FIG. 4*a* and FIG. 4*b* and once in top view, be designed as longitudinal slots 41 and once as a row of nozzles 43, as depicted in FIGS. 5*a* and 5*b*.

Figure 8:
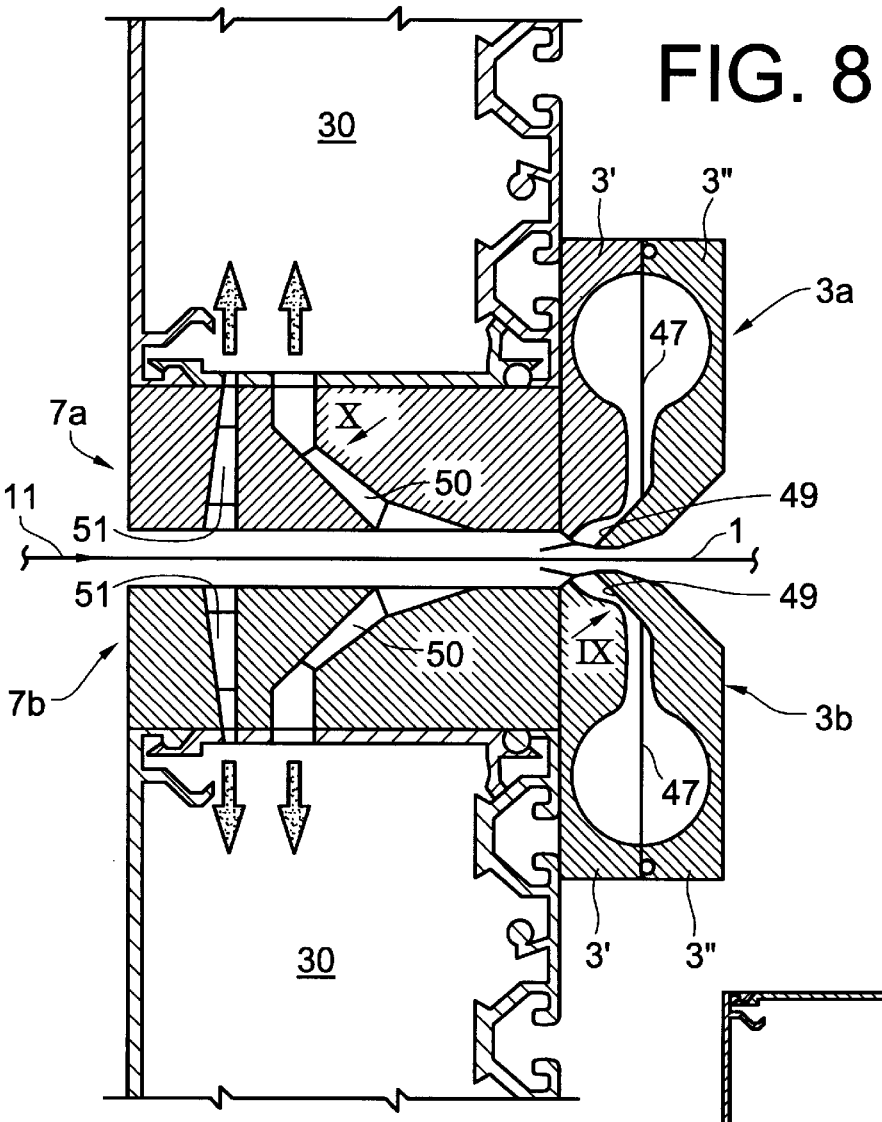
FIG. 8 shows a cross-section through the dedusting device that is depicted in FIG. 3, but with flow-influencing elements in the injection and suction units.

To improve the process of the picking up of dust particles S in ultrasonic flow of gas G, elements 49, 50, and 51 that influence flow, as indicated in FIG. 8, are arranged in widening nozzle cross-section 19 of injection units 3*a* and 3*b*, as well as in two suction channels 27 and 29.

Figure 9:
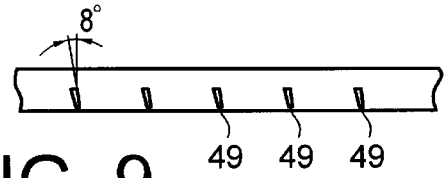
FIG. 9 shows a top view in direction of view IX in FIG. 8 on the elements of the injection unit that influence the flow.

Elements 49 that affect flow and are arranged in nozzle area 19 on wall 21 are narrow ridges, as depicted in a top view in direction of view IX in FIG. 9. Each ridge 49 lies in a plane that runs parallel to direction of movement 11, which is at an angle of 82° to material web 1. In the above-described example, ridges 49 have a width of 1 mm and are 15 mm apart.

Figure 10:
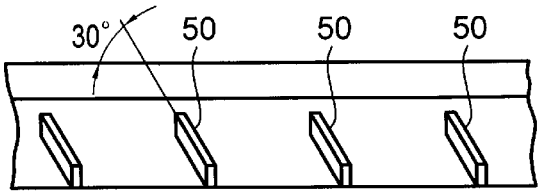
FIG. 10 shows a top view in direction of view X in FIG. 8 on the elements of the suction unit that influence the flow.

The rows of webs 50 and 51 that are arranged in suction channels 27 and 29 are narrow ridges, as depicted in a top view in direction of view X in FIG. 10. Each ridge 50 and 51 lies in a plane that also runs parallel to direction of movement 11, which runs at an angle of 60° to material web 1. In the above-described example, ridges 50 and 51 have a width of 2 mm and are 30 mm apart.

Figure 6:
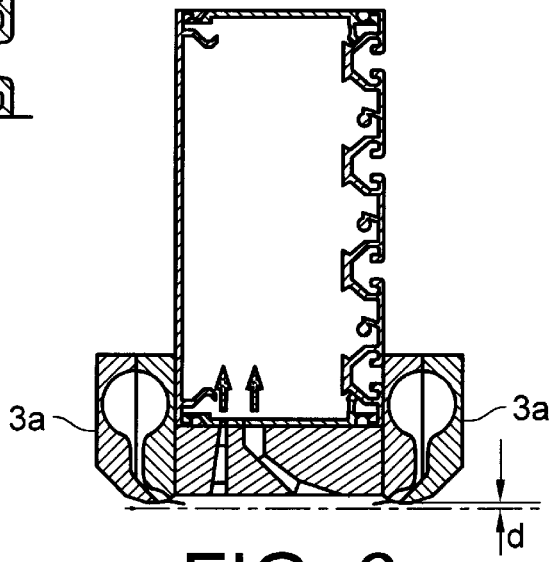
FIG. 6 shows a cross-section through a variant of the dedusting device with two injection units that are arranged on the same side of the material web surface.

In addition to injection units 3*a* and 3*b* that are arranged in FIG. 3, another injection unit, as depicted in FIG. 6, can also be arranged on both sides of the suction unit or units 7*a* and 7*b*.

Figure 7:
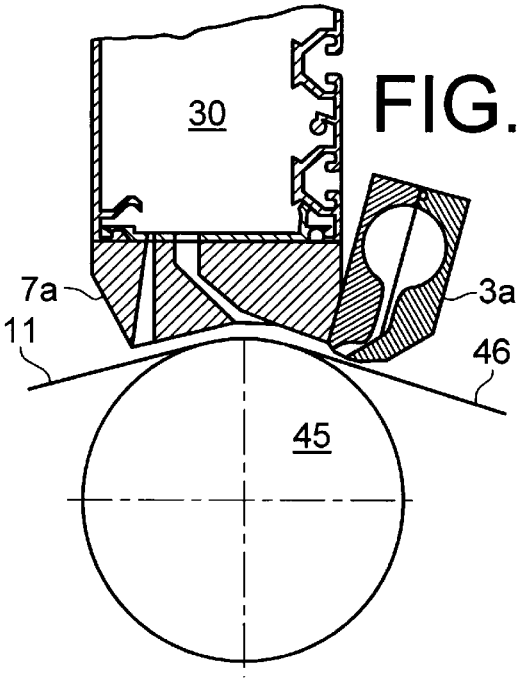
FIG. 7 shows a cross-section through another variant of the dedusting device, in which the material web that is to be dedusted is deflected.

Instead of planar material webs 1, material webs 46 that are deflected by a deflecting unit 45 can also be dedusted. The position of the injection unit, as well as that of the suction unit, is then matched, as depicted in FIG. 7, to the course of material web 46. The angle at which material web 46 separates from deflecting unit 45 is preferably between 15° and 20°, in order to keep an electric charge from accumulating unnecessarily because of charge exchange and charge separation.

The division of injection unit 3*a* or 3*b* into two pieces, already mentioned above, with partial pieces 3' and 3" allows for simpler production compared to a one-piece embodiment. The division is done along line 47, which turns into straight line 19. Sealing is done by means of a sealing ring 48, whose layout is placed depending on whether row of nozzles 43 or longitudinal slot 41 is used. Only the division of injection unit 3*a* or 3*b* makes it simple to produce elements 49 that influence flow.

Injection units 3*a* and 3*b*, as well as the corresponding suction units 7*a* and 7*b*, are preferably designed as blocks which can be set up in rows next to one another parallel to the movement of material web 1 to be able to adapt the width of the dedusting device to the respective material web width that is to be dedusted in each case.

Instead of having the material web move, the dedusting device can, of course, also be moved over the material web.

Generally, however, the material web is pulled through under or between the nozzle outlets and intakes.

With the above-described dedusting device, not only material webs can be dedusted, but also plates and sheets.

The above-described dedusting device can be used to dedust any web-shaped and plate-shaped material, such as pressboard plates, table leaves; plastic, paper, board bindings; glass, general foils; metal and medicinal foils, textiles, printed circuit boards, industrial interweaving, film and magnetic stripes, etc.

Figure 11:
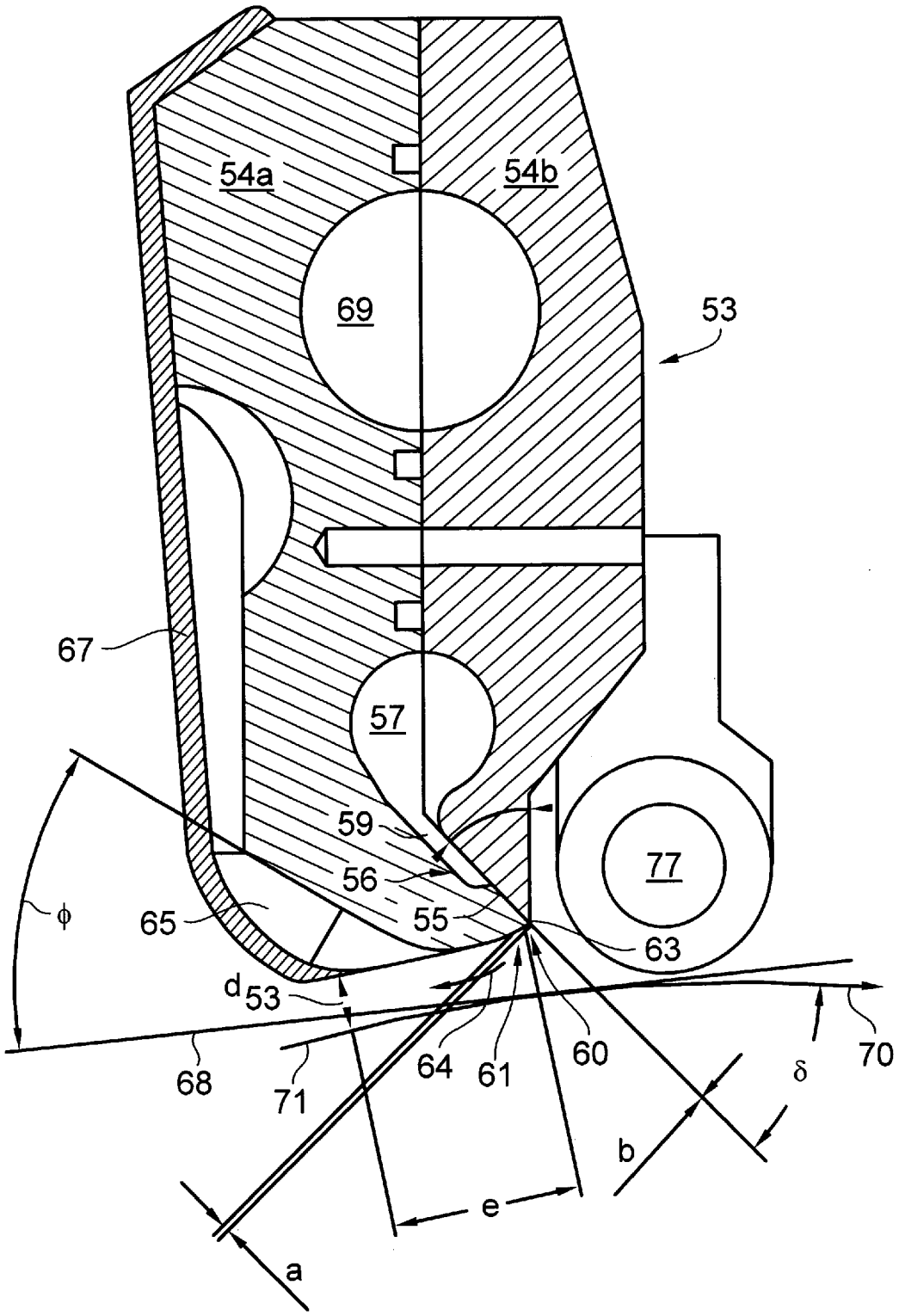
FIG. 11 shows a longitudinal section through a variant of an injection and suction unit.

Instead of injection units 3*a* and 3*b* that are depicted in FIGS. 3 to 10, unit 53 that is depicted in FIG. 11 can also be used, which represents a combination of an injection unit with a suction unit. Also, it is possible to operate at a gas discharge speed in the ultrasonic range relative to injection units 3*a* and 3*b;* but it is also possible to work in the range of the speed of sound. Analogously to injection units 3*a* and 3*b,* unit 53 is also made of two grounded nozzle parts 54*a* and 54*b* and has a narrowing 55 of nozzle channel cross-section 56. Starting from a pressure channel 57 that is designed analogously to pressure channel 13, this nozzle also has a tapering nozzle cross-section 59 (analogously to 15). In contrast to injection units 3*a* and 3*b,* however, narrowing 55 that has straight surface lines up to nozzle outlet 60 is preferred and thus is significantly longer. Thus, a stronger ionization effect (ballo-electricity) is exerted here on the gas that flows through. The axis of narrowing 55 has a preferred angle a of about 51° with tangent 68 to material surface 71. Other values for angle σ between 20° and 100° and especially between 30° and 55° can also be used. The value that was cited in the embodiment allows, however, an optimum procedure, especially with respect to low air consumption and good pressing of material web 71 that is to be dedusted on drum 74 (pressure cylinder).

Analogously to above injection units 3*a* and 3*b,* this unit 53 also has a fluidically "widening nozzle cross-section," which now forms here space 61 in front of nozzle outlet 60. In contrast to above injection units 3*a* and 3*b,* namely here edge 63 of one nozzle channel side that is designed analogously to lower edge 22 is extended outward relative to the other by an edge height a of 0.1 mm to 0.9 mm, here around 0.6 mm. This extension, on the one hand, widens a nozzle channel and, on the other hand, deflects the flow of gas that exits as indicated by arrow 64. This flow of gas thus produces a suctioning effect, which conveys the dust particles into suction unit 65, which ultimately determines the direction of flow by an arranged row of webs in a suction channel and in the end plays a very important role for conveying dust particles to a suction hose.

Width b of narrowing 55 is adjusted together with the gas pressure in pressure channel 57 in such a way that optimum dedusting is accomplished with the lowest possible air consumption. In the embodiment variants that are described here, it is possible to work with a width of the narrowing of 0.04 mm at a pressure of 1.5 bar in pressure channel 57 and a distance d/53 of 4 mm to 7 mm, preferably 5 mm. The inclination of narrowed nozzle channel 55 relative to tangent 68 to material web 71 here is, for example, 51'.

A suction unit that is integrated into unit 53 consists of a suction channel 65 that is designed in an approximately similar way to suction channel 35, 37 and 39, whereby here in a more simply structured embodiment, one channel wall is formed only by a joinable, appropriately shaped sheet 67. Also here, the material web has an intake of suction channel 65 that is analogous to an acute angle ø in direction of travel 70, already described above. Angle ø should have a value of between 20° and 50° and preferably between 33° and 39°. The edge of the intake opening of suction channel 65 that faces nozzle outlet 60 is located at a distance e, which is 17 mm in the embodiment.

To minimize the air consumption that is required for dedusting, pressure channel 57 is subdivided into individual partial channels in the crosswise direction relative to material web 71. These partial channels, not specifically shown, which are identical in FIGS. 11 and 12 to reference 57, are connected to a supply chamber 69, in each case, via a supply channel that can be sealed with a plunger (not shown). For pressure compensation, the supply channels have slightly changing flow cross-sections. The plungers can be adjusted via a mechanism, not shown, in such a way that starting from the outside periphery, one supply channel after the other can be separated and thus also one partial channel after the other can be separated from the air supply and thus from supply chamber 69. Thus, adaptation to the web width that is actually to be cleaned is possible. Only the required number of partial channels are supplied with compressed air, and thus air consumption is optimized, i.e., minimized.

Figure 12:
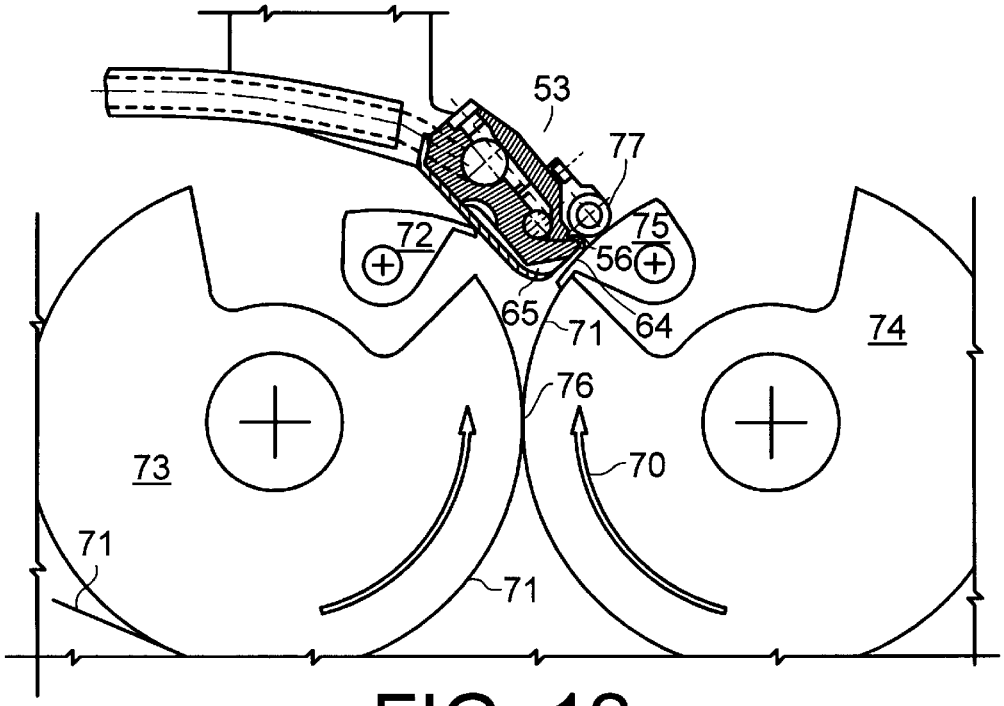
FIG. 12 shows a diagrammatic representation of a dedusting device with the injection and suction unit that is depicted in FIG. 11 for dedusting a sheetlike substance.

FIG. 12 shows the arrangement of injection unit/suction unit 53 in a dedusting device for sheet-shaped material 71. Sheets 71 that are to be cleaned are clamped and held in each case by a clamp 72 on a first drum (73) (supply cylinder). The transfer to a second drum 74 (pressure cylinder) is carried out at its point 76 where it approaches adjacent clamps 72 and 75, whereby, synchronously, clamps 72 are opened and clamp 75 is closed to pick up the sheets. The representation in FIG. 12 shows material 71, already picked up from clamp 75 with open clamp 72 open, whereby a portion of sheet-shaped material 71 rests on drum 73 and is taken up on the latter. Injection/suction unit 53 is associated with drum 74, on which are arranged safety rollers 77 in the crosswise direction relative to the width of material 71, which is supposed to guarantee the guiding of sheet-like material 71 in the case of a failure of air flow or imperfect transfer of sheets.

As a result of the high rotary speeds of drums 73 and 74 that are used, sheets 71 (material) tend to pull away or detach from the drum surface. With the devices according to the invention, in addition to dedusting, this lifting can now be adjusted satisfactorily by adjusting the air pressure. If, however, the air pressure is adjusted in such a way that only satisfactory dedusting is achieved, the latter can be too small to "fix" the sheets. In this case, safety roller 77 then ensures the desired clamping action.

I claim:

1. A process for removing dust particles from a relatively moving, especially stable material web surface with a dedusting device that operates without contact, comprising:

providing grounded potential surface area that faces the material web surface of an injection unit of a dedusting device which is arranged at a distance (d; d/53) from the material web surface, the speed and pressure between a material web surface area that is to be dedusted in each case and the potential surface of a flow of gas that exits from the injection unit are adjusted, so that a critical voltage that is associated with a product of pressure and distance according to Paschen's Law lies below an electrostatic voltage of the dust particles on material the web surface so that they are neutralized, and thus the holding forces of the dust particles on the material web surface are overcome, and the dust particles are picked up only by a flow of gas without using an ionization unit that requires electrical energy, and are suctioned off by at least one suction unit.

2. A process according to claim 1, wherein the flow of gas, especially a flow of air, is blown at an angle (α, σ) of between 20° and 100°, preferably between 30° and 55°, onto the material web surface and is suctioned off by at least one suction unit that is downstream with regard to the direction of gas flow, which is upstream in the direction of travel of the material.

3. A process according to claim 2, wherein the dust particles that are lifted by the flow of gas from the material web surface are picked up by a first suction opening that is inclined at an angle (σ, ϕ) of between 20° and 70°, preferably at 45° from direction of gas flow, and preferably are picked up by an additional second suction opening that is approximately perpendicular to the material web surface.

4. A dedusting device for carrying out the process according to claim 1 comprising:

an injection unit that is connected to a supply unit, as well as a suction unit, wherein the injection unit, starting from the supply unit, has a continuously tapering nozzle cross-section, which turns into a widening cross-section after a narrowing cross-section, the injection unit has an electrically conductive surface area that is grounded and faces a material web surface area that carries dust particle, whereby the gas pressure in the supply unit, as well as a distance (d; d/53) of the grounded surface area from the material web surface area that is to be dedusted continuously in each case can be adjusted in such a way that dust particles can be removed without any use of an ionization unit that can be connected to an electrical energy source to ionize the gas flow and can be suctioned off by suction unit.

5. A device according to claim 4, wherein the gas pressure in the supply unit, the distance (d; d/53) of the grounded potential surface from the material web surface area that is to be dedusted and the configuration of the nozzle cross-section and its position up to the area to be dedusted are adjusted, so that, depending on the product of distance (d, d/53) and the second gas pressure that can be produced by the injection unit by the gas pressure in the supply unit between the grounded surface area and material web surface area that is to be dedusted and in each case is to be pulled continuously past, the critical voltage of Paschen's Law lies below an electrostatic voltage that holds dust particles in the area.

6. A device according to claim 4, wherein the nozzle outlet is arranged, so that its exiting flow of gas strikes the latter opposite a direction of travel of the material web.

7. A device according to claim 4, wherein the axis of nozzle channel of the injection unit lies in a plane that lies at an angle (α; σ) of between 20° and 100°, preferably between 30° and 55°, with respect to the material web or its tangent.

8. A device according to claim 7, wherein the wall of the nozzle of the injection unit has at least one asymmetrically designed wall area on its axis, especially in the area of an opening, whereby one of the nozzle channel surface lines of the injection unit is a straight line, which lies in a plane that runs at an angle (α; σ) of between 20° and 100°, preferably between 30° and 55°, with respect to the material web.

9. A device according to claim 8, wherein the straight nozzle channel surface line ends in a sharp edge at nozzle outlet to produce an area of turbulent flow extending from the outlet toward the material web surface.

10. A device according to claim 4, wherein a suction opening of the suction unit is tapered like a funnel starting from suction opening, whereby one of nozzle surface lines is a first straight line, which runs in a plane that lies at an angle (β, ϕ) to the material web of between 15° and 50°, especially between 33° and 39°.

11. A device according to claim 4, wherein a injection unit is made of at least two partial pieces and preferably separating line(s) run(s) through the straight line of the nozzle channel surface line.

12. A device according to claim 4, wherein by a division into blocks preferably parallel to a relative direction of movement of the material web in order to be able to match the device width to the width of the material web.

13. A device according to claim 4, wherein a first and a second injection unit that are arranged at a distance from one another in a relative direction of movement of the material web, on both sides of which injection unit are arranged the suction unit, so that the axes of the injection nozzle channels of the first and the second injection units are directed against one another.

* * * * *